US006912740B2

(12) United States Patent
Fainberg

(10) Patent No.: US 6,912,740 B2
(45) Date of Patent: Jul. 5, 2005

(54) APPARATUS FOR COMPLETELY BATHING ONESELF BY USERS OF WHEELCHAIR AND AN ELDERLY, INFIRM PEOPLE

(76) Inventor: Abram Fainberg, 7 Roger Williams Green, Providence, RI (US) 02904

( * ) Notice: Subject to any disclaimer, the term of this patent is extended or adjusted under 35 U.S.C. 154(b) by 25 days.

(21) Appl. No.: 10/922,290

(22) Filed: Aug. 20, 2004

(65) Prior Publication Data

US 2005/0039252 A1 Feb. 24, 2005

Related U.S. Application Data

(63) Continuation-in-part of application No. 10/642,537, filed on Aug. 18, 2003, now Pat. No. 6,817,045.

(51) Int. Cl.[7] ..... A47K 3/022; A47K 3/28

(52) U.S. Cl. ..... 4/605; 4/560.1; 4/564.1; 4/565.1; 4/606

(58) Field of Search ..... 4/559, 560.1–566.1, 4/579, 601, 604–606; 601/97, 98

(56) References Cited

U.S. PATENT DOCUMENTS

| | | | | | |
|---|---|---|---|---|---|
| 3,040,335 A | | 6/1962 | Gellmann | 4/185 S X |
| 3,802,421 A | * | 4/1974 | Williams | 4/559 |
| 4,150,445 A | | 4/1979 | Bailly | 4/185 L |
| 4,356,583 A | * | 11/1982 | Wallasch et al. | 601/97 |
| 5,129,112 A | * | 7/1992 | Schaffer | 4/560.1 |
| 5,335,378 A | * | 8/1994 | Chiang | 4/606 |
| 5,373,591 A | * | 12/1994 | Myers | 4/560.1 |
| 5,561,868 A | * | 10/1996 | Campbell | 4/560.1 |
| 5,606,751 A | | 3/1997 | Baker | 4/560.1 |
| 5,715,545 A | | 2/1998 | Forwick | 4/563.1 |
| 6,240,577 B1 | | 6/2001 | Worthy | 4/578.1 |

OTHER PUBLICATIONS

U.S. Appl. No. 10/642,537, filed Aug. 18, 2003, Fainberg.

* cited by examiner

*Primary Examiner*—Tuan Nguyen

(57) ABSTRACT

Two versions of apparatus for completely bathing oneself by users of wheelchair and elderly, infirm people are disclosed. Both versions includes a slidable up and down carriage with reciprocating belt for soaping and showering bathers back, a chair with coil under the seat for washing bottom parts of the body, a hand shower, and an appliance for washing the feet. For users of wheelchair the chair is designed for sliding with the bather from exterior of the bathtub to the interior of the bathtub. In version for elderly, infirm people the chair seat is fixed in position over the longitudinal lip of the bathtub to let the user to sit down on this chair as well as he sat on a standard chair or toilet. The users back in this case will be in area of the bathtub, while the feet will be out and the water, which coming out will be gathered by curtain in folding tray and pumped back in the bathtub.

8 Claims, 6 Drawing Sheets

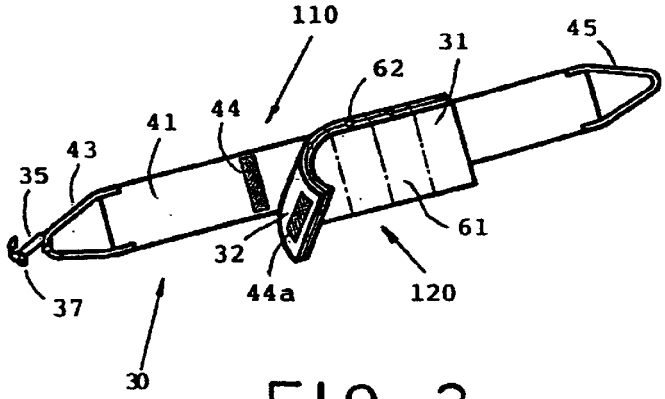
FIG. 3
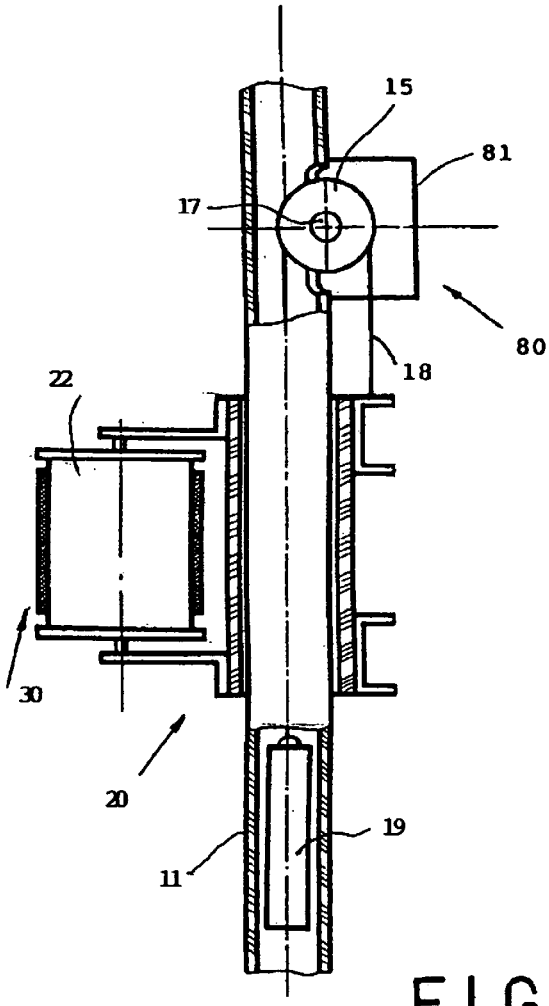
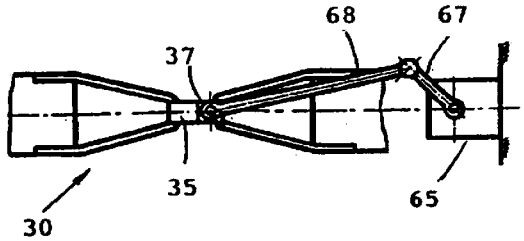
FIG. 4
FIG. 2

APPARATUS FOR COMPLETELY BATHING ONESELF BY USERS OF WHEELCHAIR AND AN ELDERLY, INFIRM PEOPLE

CROSS REFERENCE TO RELATED APPLICATION

This application is a continuation-in-part application of U.S. application Ser. No. 10/642,537 filed Aug. 18, 2003 now U.S. Pat. No. 6,817,045, now allowed for a patent.

BACKGROUND OF THE INVENTION

1. Field of the Invention

The present invention relates to bathing devices and, more particularly, pertains to assisting a wheelchair user and an elderly, infirm person to bathe oneself completely, safety and in a comfortable position.

2. Description of the Prior Art

A variety of bathtub inserts are known in the art. A number of these devices in different fulfillment intend that persons safely set into and out of a conventional tub. For instance, U.S. Pat. No. 6,240,577 to Worthy discloses a bathtub mountable chair seat for the transfer of a physically challenged bather from the exterior of a typical bathtub to the interior of the bathtub for bathing, U.S. Pat. No. 5,715,545 to Forwick discloses a telescoping chair lift device, U.S. Pat. No. 5,606,751 to Baker discloses apparatus in which the bather is seated in the chair from outside the bathtub, then the chair is rotated and slid laterally until the person is positioned inside the bathtub for bathing or showering. While all of these devices fulfill their respective, particular objective and requirements, the aforementioned patents do not disclose an apparatus permitting disabled and infirm persons to bathe himself/herself completely (including back, bottom, and feet) without an assistant.

U.S. Pat. No. 3,040,335 to Gelman and U.S. Pat. No. 4,150,445 to Bailly shown a shower chair assembly whereby the sprays, directed from under the seat, can cleans the ano-genital areas of the body. However, the users of both of these devices can't completely bathe themselves without assistance from another person. Furthermore these suggested devices are too complicated and unacceptable for the present purposes due both to the relatively high initial cost, and also to the loss or restriction of the facility for normal use when anyone wishes a regular shower or bath.

In U.S. application Ser. No. 10/642,537 filed Aug. 18, 2003, I presented an apparatus for safely, comfortably and completely bathing oneself. For bathing the user must come into the bathtub, seat on the chair and washes all parts of the body by using bathing tools of the apparatus. But people who use for transportation a wheelchair can't oneself come inside of the bathtub. Also can't come inside of the bathtub and some elderly, infirm people. These disadvantages are overcome by the present invention in the matter of use the Bathing tools (which are disclosed in my application U.S. Ser. No. 10/642,537 filed Aug. 18, 2003) and additional a new matter wherein:

A. For users of Wheelchair, the chair seat can transfer the bather from exterior of the bathtub to its interior;

B. For elderly, infirm people the chair seat is fixed in position over the longitudinal lip of the bathtub to let the user sit down on this chair as well as he would on a standard chair or toilet. The user's back in this case will be in area of the bathtub, while the feet will be out, and the water, which comes out, will be gathered by curtain into folding tray and pumped back in said bathtub.

SUMMARY OF THE INVENTION

In accordance with the present invention the apparatus for bathing oneself conserves all advantages of U.S. application Ser. No. 10/642,537 filed Aug. 18, 2003, now allowed for a patent, that are:

To provide an apparatus for bathing in safety and comfort for a broad category of users, including elderly and disabled persons;

To provide a bathing apparatus that the user can operate safely in sitting position without aid of another person;

To provide a bathing apparatus, which does not require any special modification to a conventional tub structure;

To provide a bathing apparatus with elements for bathing all parts of one's body including back, seat, and feet;

To provide a bathing apparatus that does not require that it be moved out in cases when anyone would want a regular shower or bath;

To provide a bathing apparatus, which will conform to conventional forms of manufacture, be of simple construction, easy to use, economically feasible, long lasting, and relatively trouble free in operation, and Additionally:

1. To provide an apparatus for bathing in safety and comfort for persons who use for transportation a wheelchair, and 2. To provide an apparatus for bathing in safety and comfort for elderly, infirm people who can't by themselves get into bathtub to sit on chair for bathing.

These together with other objectives of the invention, along with the various features of novelty, which characterize the invention, are pointed out with particularity in the claims annexed to and forming a part of this disclosure. For a better understanding of the invention, its operation advantages and the specific benefits attained by its uses, refer to the accompanying drawings and descriptive matter in which there are illustrated preferred embodiments of the invention.

BRIEF DESCRIPTION OF THE DRAWING

FIG. 2 is a sectional view taken along line 2—2 of FIGS. 1A and 1B with portions broken away illustrating the primary structure of the carriage and its drive mechanism for moving up and down;

FIG. 3 is a perspective view of the reciprocation belt;

FIG. 4 is a schematic view of the drive mechanism for providing the belt in reciprocation movement;

DESCRIPTION OF THE PREFERRED EMBODIMENTS

Figure 1A:
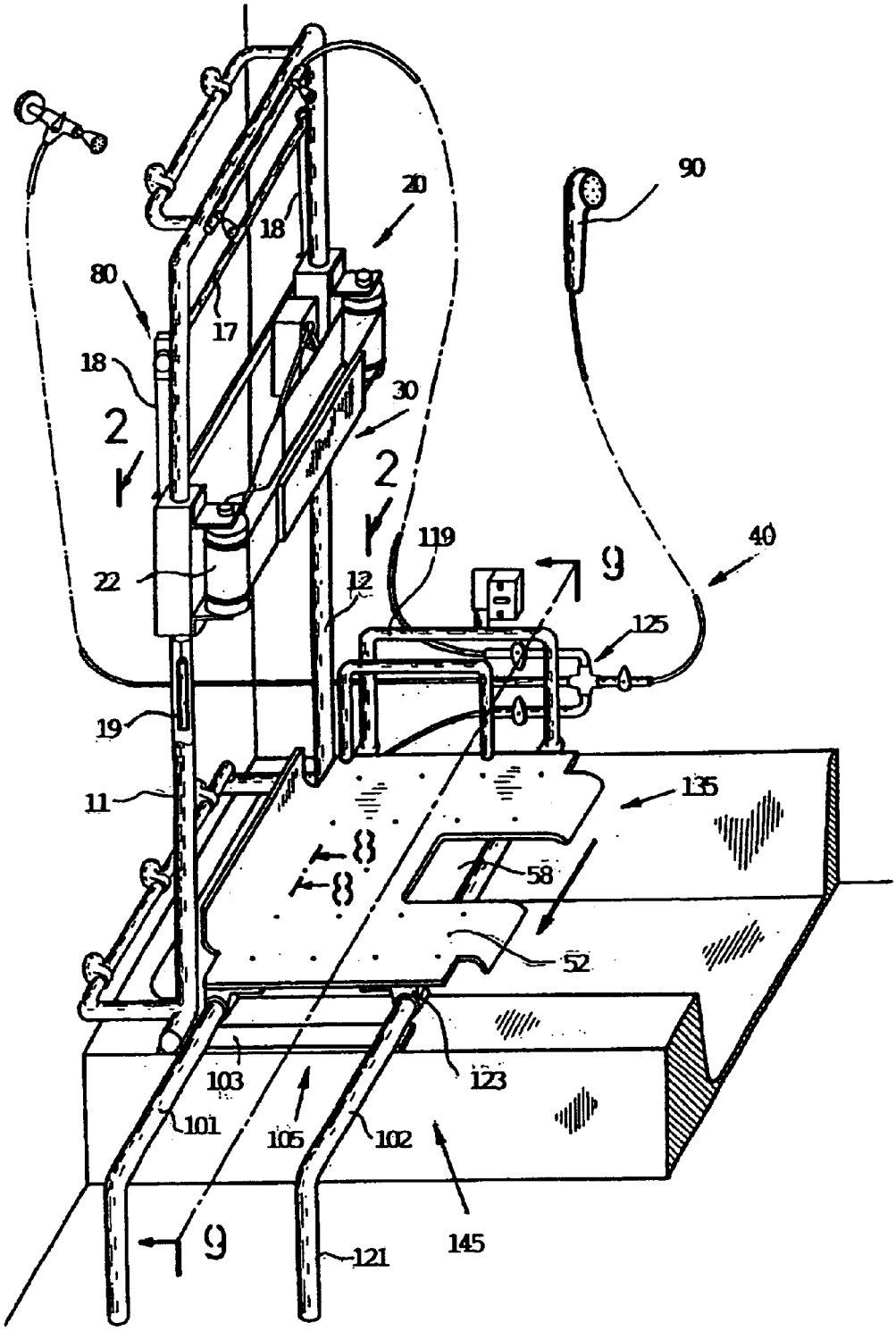
FIG. 1A is a perspective view of the preferred bathing apparatus with portions broken away for users of a wheelchair.

The present invention is an apparatus for completely bathing oneself by the users of a wheelchair and an elderly, infirm persons all his/her body including back, seat, and feet.

Bathing Apparatus for Users of a Wheelchair.

The apparatus (FIG. 1A) is intended to facilitate movement of a seated person from exterior of the bathtub to its interior. The apparatus includes a frame 145 with posts 11 and 12 on which slides a carriage 20 with means of a reciprocation belt 30 for soaping, scratching, and massaging bathers back, a water supply system 40, a chair 135, and an appliance 70 (FIG. 5) for bathing and massaging the feet.

The movement of the carriage 20 up and down is provided by drive means 80 (FIG. 2) heaving two sheaves 15 rigidly attached on a rotation axle 17, a gear-motor 81, which operates the axle 17. The carriage 20 by ropes 18, to be thrown on grooves of the sheaves 15, is connected with counterweights 19 to provide easy movement of the carriage. The means of reciprocation belt 30, as shown in FIG. 3, consist of a permanently installed belt 110 and a removable piece of bast 120. The belt 110 includes a synthetic strap 41, a rope, which forms a loop 43, adjustable cord, which forms a second loop 45, and a grip 35. Connection the rope and the cord to the synthetic strap 41 are provided by stitching or gluing.

As it seen in FIG. 1A the means of reciprocation belt 30 is situated on the rolls 22 of the carriage and joined by grip 35 (FIG. 4). The loop 45 (FIG. 3), which is made from adjustable cord, holds the belt 30 in tension position. The grip 35 has a hook 37 for affecting a reciprocating motion to the belt 30. The removable piece of bast 120 has two straps 31 and 32. The strap 31 is made of a special bathing material, from natural fiber loofah, which is excellent for cleansing the skin. The other strap 32 is made from regular soft cloth. Both straps 31 and 32 are stitched together so that between them is formed one or more pockets 61, in which through holes 62 can be pumped soap. In the process of bathing by pressure from the uses back this pumped soap goes out through small holes in the strap 31 (not shown) to form lather. For attaching the piece of bast 120 to belt 110 may be use quick fastener strips 44 and 44*a* market "sticky back" of the Velcro Co. or the like.

Reciprocation of the belt 30 as it seen in FIG. 4 is provided by gear-motor 65, which is installed in water resistant case and mounted on the carriage 20. Crank 67 and connection rod 68 transfer the motion from the gear-motor 65 to the belt 30.

Figure 7:
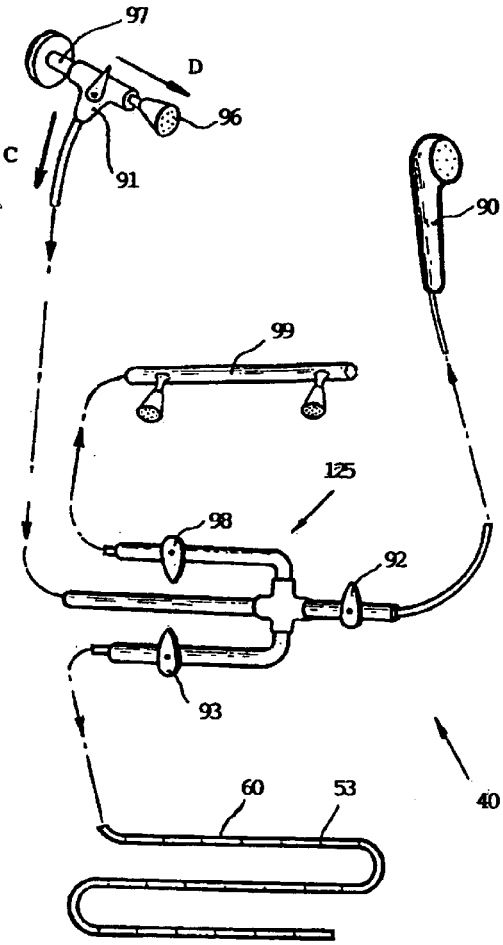
FIG. 7 is a schematic view of the water supply system.

The water supply system 40, as shown in FIG. 7, comprises a valve 91 for direction water at arrow "C" (in case of bathing) or at arrow "D" (in case of taken a regular shower), a valve 92 for supplying water to hand shower 90, a shower means 99, which operated by valve 98 for showering the users back, a valve 93 for spraying water by perforated coil 60, and some pieces of hoses suitable length for connection with the valves. The valves 92, 93 and 98 are putted together to form a water control means 125. The installation of the water supply system 40 in a common bathroom includes to screwing the valve 91 between domestic pipe 97 and showerhead 96.

Figure 5:
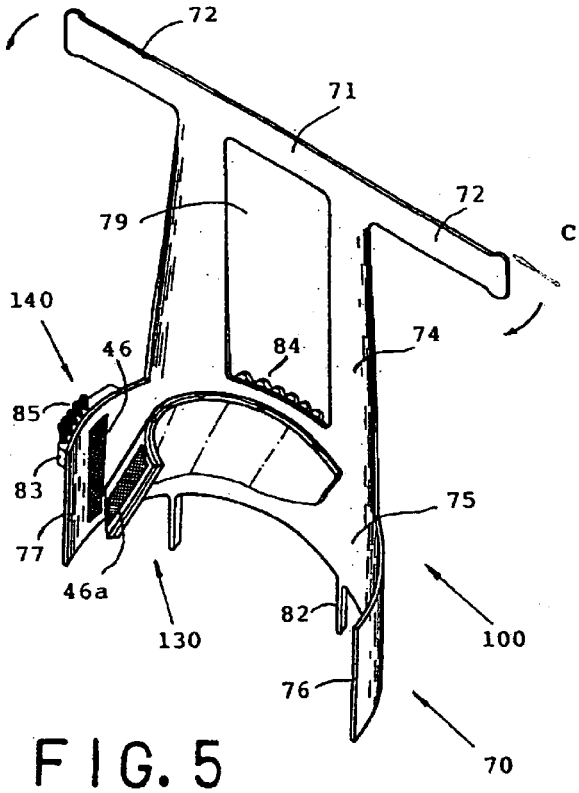
FIG. 5 is a perspective view of the appliance for bathing and massaging the feet.
Figure 6:
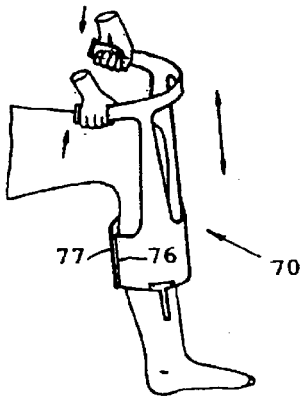
FIG. 6 is a perspective view of the appliance for bathing and massaging the feet in the process of bathing.

Washing the feet (from knee and lower) is a problem not only for elderly people but also for everybody especially for washing between toes and bottom of foot. This problem will be sold by using an appliance 70 (FIGS. 5 and 6). The appliance comprises a base 100 preferably molded from plastic in a one-piece construction, removable piece of bast 130 and a set of massaging attachments 140. The upper portion of the base 100 is a straight strip 71 with two handles 72. In the middle part of the strip 71 the thickness is smaller for easy bending (FIG. 6). By two legs 74, which apart about 5", the strip 71 is connected with lower portion 75 to form an opening 79 for massaging the feet at edges of the opening. The lower portion 75 has the form of a broken cylinder. But when the bather bends the upper portion 71 of the base 100 the edges 76 and 77 of the lower portion 75 are closed up to form approximately a circumferential construction. To the inside surface of the portion 75 by quick fastener strips 46 and 46*a* is attached the piece of bast 130, which preferably has the same construction and size as the piece of bast 120. The portion 75 has also some fastener means (not shown) for fixation the set of attachments 140. These attachments comprise two pins 82 for cleaning between toes of the feet and several interchangeable strips 83 having numerous mechanical massaging protrusions such as knobs 84 and brushes 85. The strip 83 with knobs 84 and the pins 82 are preferably molded from suitable materials, such as known elastomeric and other rubber-like materials, which has some elastic capability. Said materials provide desirable massage textures, soft or hard, coarse or fine.

On the apparatus are installed a number of rubber suction cups 5. These cups fasten to the walls of the bathroom and to the surfaces of the tub and together with the fastener means 115 stabilize the apparatus on the tub and avoid any structural modification.

Figure 9:
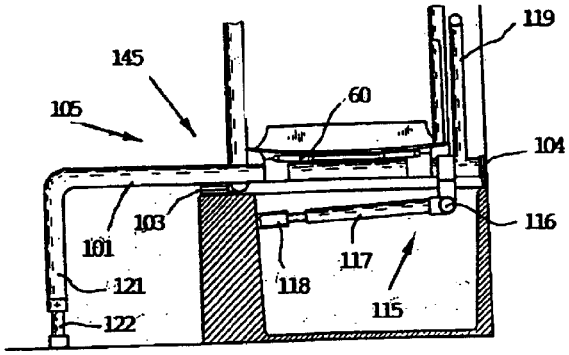
FIG. 9 is a sectional view taken along line 9—9 of FIG. 1A with portions broken away illustrating the primary structure of the apparatus for users of wheelchair.

The frame 145 (FIGS. 1A and 9) is intended to facilitate movement of a seated person from outside of the bathtub to inside and designed to rest upon the top of opposing bathtub sides. The frame comprises a pair of parallel tracks 101 and 102, which forms with spreaders 103 and 104 a rigid rectangular structure 105, and fastener means 115 to provide said frame in fixed position. The fastener means 115 includes a cross-tubular member 116 mounted to the rectangular structure 105 and one or preferably two pushers 117 pivotally attached to the member 116. Each pusher 117 has a screw means 118 for exerting pressure between rectangular structure 105 and the inner wall of the bathtub to provide stability of the frame 145.

Figure 8:
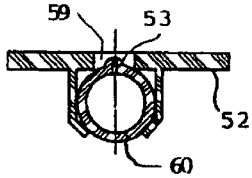
FIG. 8 is a cross sectional view of the chair-sprinkler taken along line 8—8 of FIGS. 1A and 1B.

At the rear end of the rectangular structure 105 is connected a member 119 for mounting the water control means 125 and for supporting the bather in the process of sliding into and outside of the bathtub. To the extension front end of the both parallel tracks 101 and 102 provided a leg 121 for supporting the weight of the bather. These extension ends may be accomplished in telescoping manner to provide compactness of the apparatus in bathroom. The legs 121 also may be designed to have a jackscrew or a telescoping means 122 for adjusting its length. As shown in FIG. 1A the chair seat 135 is slidably engaged with the tracks 101 and 102 by rolling means 123. In this manner the chair 135 may roll along the surfaces of the tracks 101 and 102 from one end to the other. Under the seat 52 is attached a coil 60 (FIGS. 7 and 8), which has spout holes 53 located in same position as the holes 59 in the seat 52 to provide a shower one's seat. For access to the ano-genital area of the body the seat 52 has an opening 58. And finally, to the one of the tracks 101 or 102, as desired, are connected posts 11 and 12, on which slides up and down the carriage 20.

For bathing oneself the user of wheelchair must at first move from the wheelchair to the chair 135 of the apparatus, and then in sitting position slide to the interior of the bathtub. After that the bather washes oneself by using equipment of the apparatus in same way as it disclosed in my U.S. application Ser. No. 10/642,537 filed Aug. 18, 2003: by using the hand shower 90 he washes the head and front parts of the body, by using the reciprocating belt 30 and shower means 99 he washes his back, by spray 60, mounted under the chair seat 52 he has access to cleanse the ano-genital area of the body, and by appliance 70 he washes his feet.

Bathing Apparatus for Elderly, Infirm People

The apparatus (FIG. 1B) for elderly, infirm people allows the user to sit down on a chair for bathing as well as he sits on a standard chair or toilet, form a waterproof booth and take a bath.

The apparatus includes a frame 150 with posts 11 and 12, on which slides a carriage 20 with means of a reciprocation belt 30 for soaping, scratching, and massaging bathers back, a water supply system 40, a chair seat 170, a folding booth 180 and an appliance 70 (FIG. 5) for bathing and massaging the feet.

The movement of the carriage 20 up and down is provided by drive means 80 (FIG. 2) having two sheaves 15 rigidly attached on a rotation axle 17, a gear-motor 81, which operates the axle 17. The carriage 20 by ropes 18, to be thrown on grooves of the sheaves 15, is connected with counterweights 19 to provide easy movement of the carriage. The means of reciprocation belt 30, as shown in FIG. 3, consist of a permanently installed belt 110 and a removable piece of bast 120. The belt 110 includes a synthetic strap 41, a rope, which forms a loop 43, adjustable cord, which forms a second loop 45, and a grip 35. Connection the rope and the cord to the synthetic strap 41 are provided by stitching or gluing.

Figure 1B:
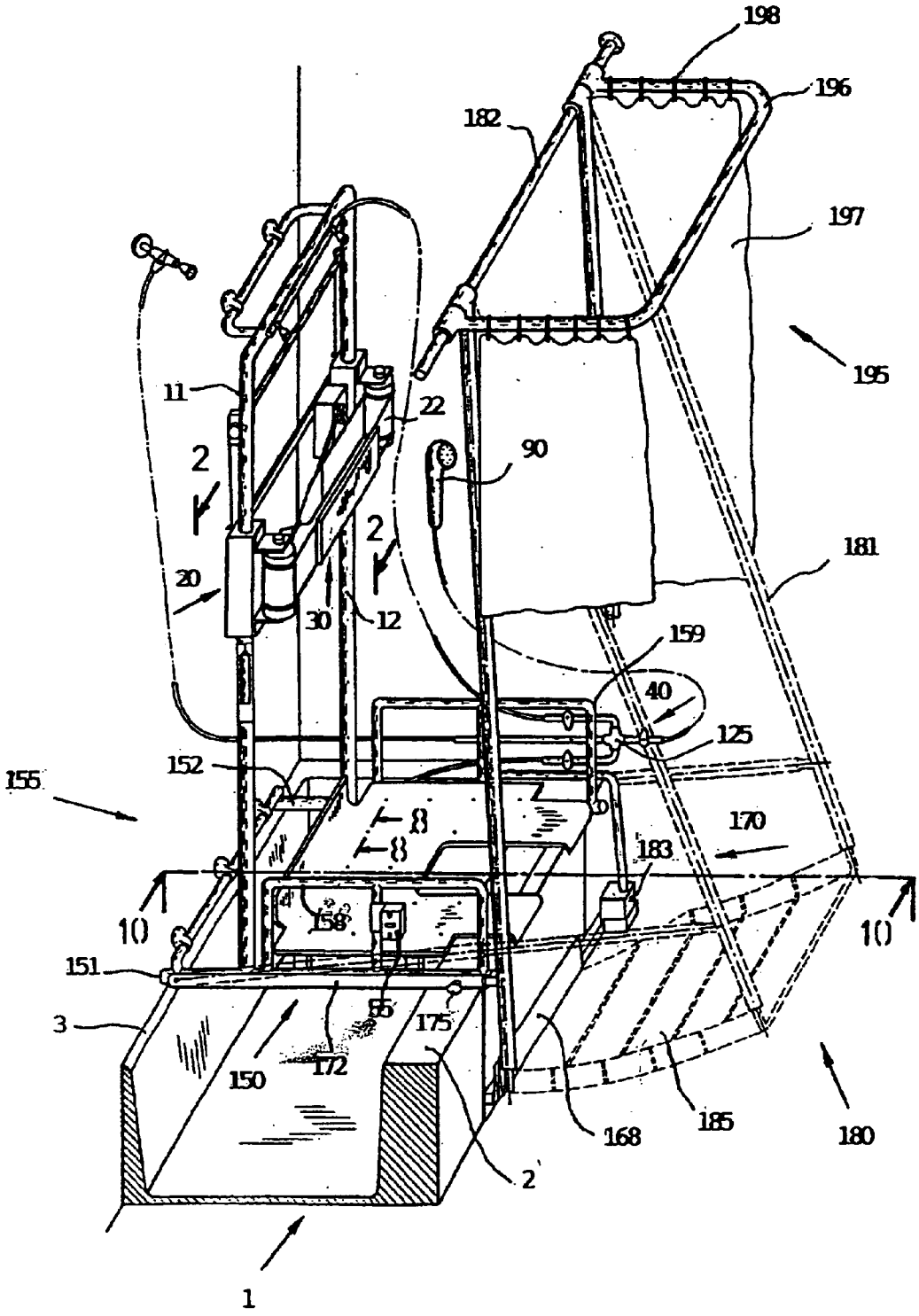
FIG. 1B is a perspective view of the preferred bathing apparatus with portions broken away for elderly, infirm people.

As it seen in FIG. 1B the means of reciprocation belt 30 is situated on the rolls 22 of the carriage and joined by grip 35 (FIG. 4). The loop 45 (FIG. 3), which is made from adjustable cord, holds the belt 30 in tension position. The grip 35 has a hook 37 for affecting a reciprocating motion to the belt 30. The removable piece of bast 120 has two straps 31 and 32. The strap 31 is made of a special bathing material, from natural fiber loofah, which is excellent for cleansing the skin. The other strap 32 is made from regular soft cloth. Both straps 31 and 32 are stitched together so that between them is formed one or more pockets 61, in which through holes 62 can be pumped soap. In the process of bathing by pressure from the uses back this pumped soap goes out through small holes in the strap 31 (not shown) to form lather. For attaching the piece of bast 120 to belt 110 may be use quick fastener strips 44 and 44*a* market "sticky back" of the Velcro Co. or the like.

Reciprocation of the belt 30 as it seen in FIG. 4 is provided by gear-motor 65, which is installed in water resistant case and mounted on the carriage 20. Crank 67 and connection rod 68 transfer the motion from the gear-motor 65 to the belt 30.

The water supply system 40, as shown in FIG. 7, comprises a valve 91 for direction water at arrow "C" (in case of bathing) or at arrow "D" (in case of taken a regular shower), a valve 92 for supplying water to hand shower 90, a shower means 99, which operated by valve 98 for showering the users back, a valve 93 for spraying water by perforated coil 60, and some pieces of hoses suitable length for connection with the valves. The valves 92, 93 and 98 are putted together to form a water control means 125. The installation of the water supply system 40 in a common bathroom includes to screwing the valve 91 between domestic pipe 97 and showerhead 96.

The chair seat 170 (FIG. 1B), which is mounted to the frame 150 in position over the front longitudinal side 2 of the tub 1, allows the user to easily sit down for bathing. Under the seat 52 is attached a spray 60 (FIGS. 7 and 8), which has spout holes 53 located in same position as the holes 59 in the seat 52, to provide a shower one's seat. For access to the ano-genital area of the body the seat 52 has an opening 58.

Washing the feet (from knee and lower) is a problem not only for elderly people but also for everybody especially for washing between toes and under the foot. This problem will be sold by using an appliance 70 (FIGS. 5 and 6). The appliance comprises a base 100 preferably molded from plastic in a one-piece construction, removable piece of bast 130 and a set of massaging attachments 140. The upper portion of the base 100 is a straight strip 71 with two handles 72. In the middle part of the strip 71 the thickness is smaller for easy bending (FIG. 6). By two legs 74, which apart about 5", the strip 71 is connected with lower portion 75 to form an opening 79 for massaging the feet at edges of the opening. The lower portion 75 has the form of a broken cylinder. But when the bather bends the upper portion 71 of the base 100 the edges 76 and 77 of the lower portion 75 are closed up to form approximately a circumferential construction. To the inside surface of the portion 75 by quick fastener strips 46 and 46*a* is attached the piece of bast 130, which preferably has the same construction and size as the piece of bast 120. The portion 75 has also some fastener means (not shown) for fixation the set of attachments 140. These attachments comprise two pins 82 for cleaning between toes of the feet and several interchangeable strips 83 having numerous mechanical massaging protrusions such as knobs 84 and brushes 85. The strip 83 with knobs 84 and the pins 82 are preferably molded from suitable materials, such as known elastomeric and other rubber-like materials, which has some elastic capability. Said materials provide desirable massage textures, soft or hard, coarse or fine.

On the apparatus are installed a number of rubber suction cups 5. These cups fasten to the walls of the bathroom and to the surfaces of the tub and together with the fastener means 115 stabilize the apparatus on the tub and avoid any structural modification.

Figure 11:
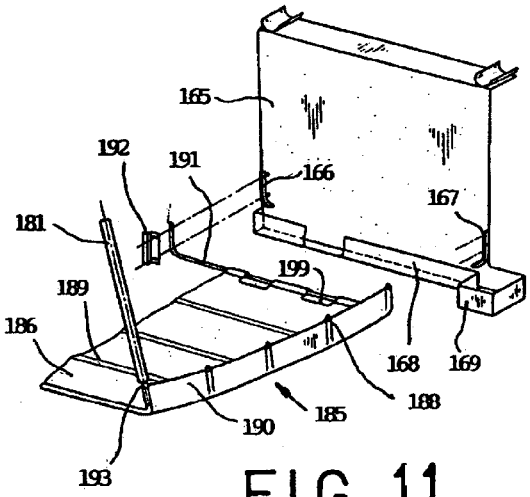
FIG. 11 is a perspective view illustrating structure of the folding tray and the sheet member of the frame of FIG. 1B and its connection.
Figure 10:
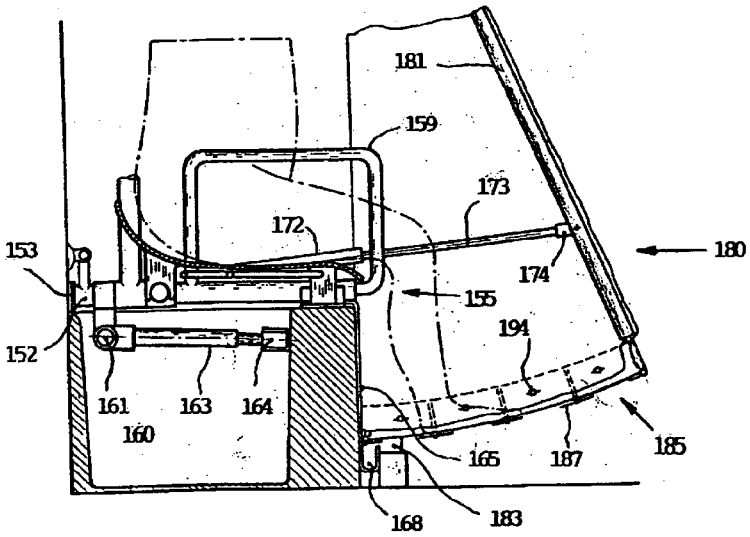
FIG. 10 is a sectional view taken along line 10—10 of FIG. 1B with portions broken away illustrating the primary structure of the apparatus for elderly, infirm people.
Figure 12:
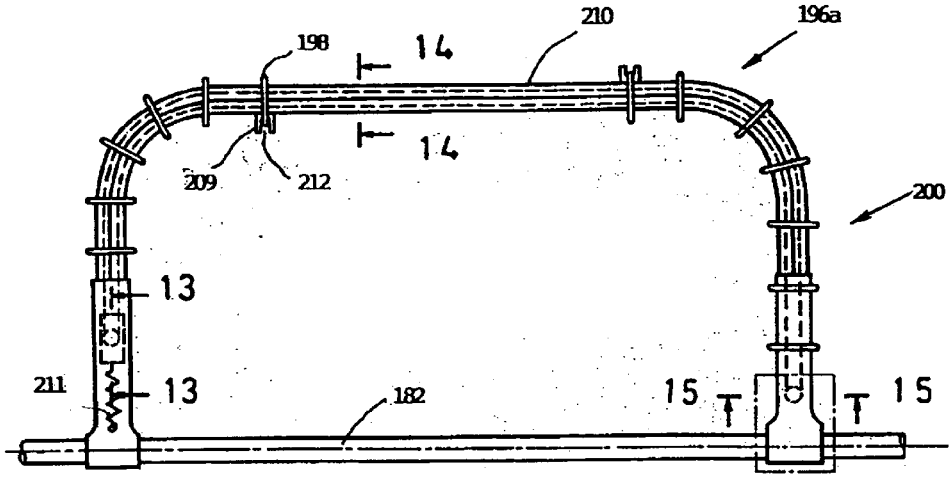
FIG. 12 is a plane view of the curtain system for automatically closing and opening the curtains of the folding booth.
Figure 13:
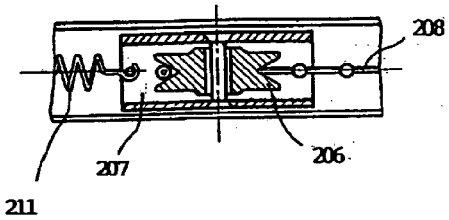
FIG. 13 is a cross-sectional view taken along line 13—13 of FIG. 12.

The frame 150 (FIGS.1B and 10) is designed to rest upon the top of longitudinal front 2 and rear 3 (adjacent to wall) sides and provided location of the chair seat 170 in position over the front side 2 to allow the bather to sit down on this chair as well as he sat on a standard chair or toilet. The frame comprises a pair of parallel tracks 151 and 152, which forms with spreaders (not shown) a rigid rectangular structure 155, and a fastener means 160 to provide the frame in fixing position. The fastener means 160 includes a cross-tubular member 161 mounted to the tracks 151 and 152 and one or preferably two pushers 163 pivotally attached to the member 161. Each pusher 163 has a screw means 164 for exerting pressure between rectangular structure 155 and the inner wall of the bathtub. To the front end of the rectangular structure 155 from bellow attached a sheet member 165 and from above to both tracks 151 and 152 attached handless 158 and 159. This handless supported the bather in the process of bathing and work as support for attaching electric 55 and water system 125 controls. To the both tracks 151 and 152 (FIGS. 1B and 10) are pivotally attached a tubular swinging arms 172 inside of which slide guides 173 with hinge 174 on the end. The swinging arms 172 has a lock means 175 for fixing the extension position of the guides 173, which defined by two holes or hollows on its surfaces (not shown). The sheet member 165 (FIG. 11), previously made from plastic in one piece, has two lateral ribs 166 and 167 with rounding ends toward each other. The bottom side of this sheet member is carrying out as a inclined gutter 168 with water receiver 169 on the end. And finally, to the tracks 151 and 152 are connected posts 11 and 12 on which slides up and down the carriage 20.

The folding booth 180 (FIGS. 1B and 10) allows to gathering water, which coming out in the process of bathing, and pumping it back in the bathtub. The folding booth comprises: two operation arms 181, a tray 185 for direction the gathered water to the gutter 168, a curtain guard 195, and a pump 183. The operation arms 181 are pivotally attached to the existed curtain crossbeam 182 of the bathroom and hingly connected with the guides 173 of the frame 150. The tray 185 (FIGS. 10 and 11) includes a piece of waterproof material 186 preferably of rectangular shape having a number of strips 187 fixed to its bottom surface to form a pipelines 189 parallel each other and equally spaced, and a number of ribs 188 with bended both ends in one direction and plane. The ribs 188 to be putted in pipelines 189 with bended ends in one direction perpendicularly to plain surface of the waterproof material 186 forms a tray 185 with rising up sides 190. The first rib 191 of the tray by two retainers 192 is fixed to the sheet member 165 while its last rib 193 is attached to the ends of the operation arms 181. The waterproof material 186 near the first rib 191 has some holes, openings 199, or slit (between the sheet member 165 and rib 191) through which drained water into inclined gutter 168. To the both rising sides 190 of the tray 185 from inside are attached a number of buttons or hooks 194. The curtain guard 195 (FIG. 1B) comprises a curved beam 196 fixed in horizontal plane to the existed curtain crossbeam 182 and two curtains 197 hanged by a standard rings 198. From below the curtains 197 have a number of loops or hook for fastening with the buttons or hooks 194 of the tray 185.

For bathing oneself the user must sit on the chair of the apparatus, push ahead the operation arms 181 until the guides 173 lock into place, and close the curtains 197. After that the bather washes oneself by using equipment of the apparatus in same way as disclosed in my U.S. application Ser. No. 10/642,537 filed Aug. 18, 2003: by using the hand shower 90 he washes the head and front parts of the body, by using the reciprocated belt 30 and shower means 99 he washes his back, by coil 60, mounted under the chair seat 52 he has access to cleanse the ano-genital area of the body, and by appliance 70 he washes his feet.

Figure 14:
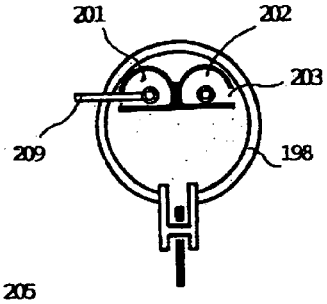
FIG. 14 is a cross-sectional view taken along line 14—14 of FIG. 12.
Figure 15:
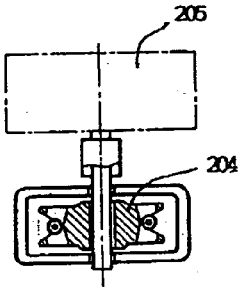
FIG. 15 is a cross-sectional view taken along line 15—15 of FIG. 12.

But for many people it will be preferable to close and open the folding booth 180 automatically rather than by hand. In this case the swinging arms 172 and guides 173 can be performed as an air or hydraulic cylinders operated by control unit (not shown). As regards to automatically movement the curtains 197, that may be accomplished by curtain means 200 (FIGS. 12 through 15), comprising: a curved beam 196*a* fixed in horizontal plane to the existed curtain crossbeam 182, a driver timing sheave 204, which operated by gear-motor 205, a driven sheave 206 placed in slidable housing 207, a timing cord 208 with two pilots 209, and a spring 211 for holding the timing cord in tension position. The curved beam 196*a* in its middle, biggest part 210 has form of a two separate tubes 201 and 202 (FIG. 14) fixed together and having each a slit 203 for sliding the pilots 209. These pilots have a slot 212 for griping and moving the rings 198 (together with fasteners curtains 197) along the beam 196*a* in both directions. After the gear-motor 205 is operated the motion through sheave 204 transferred to timing cord 208 to provide movement its branches in opposite directions to closing or opening the folding booth 180. Control over the sources for movement the operation arms 181 and curtains 197 is provided by one control unit (not shown) having two buttons: "Close" and "Open".

Although particular embodiments of the present invention have been illustrated and described, it will be apparent to those skilled in the art that various changes and modifications can be made without departing from the spirit of the present invention, and it is intended to cover in the appended claims all such changes and modifications that fall within the scope of the present invention.

I claim:

1. An apparatus for safety, comfortable, and completely bathing oneself by the users of wheelchair comprising: a frame for holding the components of the apparatus and stabilizing it on the bathtub without any structure modification of said bathtub; a carriage for sliding up and down along the vertical posts of said frame, said carriage comprising a means of reciprocation belt for soaping bathers back; a drive means for moving said carriage up and down and for operation said means of reciprocation belt; a chair means for bathing in sitting position; a water supply system; a number of rubber suction cups for stabilizing said apparatus on said bathtub; and a hand shower, wherein the improvement comprises:

a) a frame rested upon the top of the bathtub opposing sides and fixed to said bathtub by fastener means, said frame having two parallel tracks;

b) a chair seat for bathing in seating position, said chair seat having a rolling means, which engaged with said parallel tracks of the frame for facilitate movement of the seated person inside and outside of the bathtub.

2. The apparatus of claim 1 wherein said frame and said chair seat each has a support member for safety bathing and moving inside and outside of the bathtub.

3. The apparatus of claim 1 wherein said chair seat is equipped with a locking means for fixing said chair seat in bathing and transferring areas.

4. The apparatus of claim 1 wherein said chair seat has an opening for access to cleanse the ano-genital area of the body.

5. The apparatus of claim 1 wherein both parallel trucks have a telescopically adjustable portion with leg on the end for supporting the users weight, said leg having an adjustable screw means for engaging with floor.

6. An apparatus for safety, comfortable, and completely bathing oneself by the elderly, infirm people comprising: a frame for holding the components of the apparatus and stabilizing it on the bathtub without any structure modification of said bathtub; a carriage for sliding up and down along the vertical posts of said frame, said carriage comprising a means of reciprocation belt for soaping bathers back; a drive means for moving said carriage up and down and for operating said means of reciprocation belt; a chair means for bathing in sitting position; a water supply system; a number of rubber suction cups for stabilizing said apparatus on said bathtub; and a hand shower, wherein the improvement comprises:

i. a frame rested upon the top of the bathtub opposing sides and fixed to said bathtub by a fastener means, said frame, having a sheet member adapted to the front portion of said frame, and two tubular parallel swinging arms with slidable inside guides, said sheet member has an inclined gutter with water receiver on the end;

ii. a chair seat fixed in position over the longitudinal lip of the bathtub so that the bather can sit on it in same way as he sits on a standard chair or toilet;

iii. a folding booth which in extension position provide a gathering water which coming out in the process of bathing and pumping it back into bathtub, and in folding position lets the user to sit down on the chair wherein said folding booth comprising:

a) a water pump installed in said water receiver for pumping gathered water into bathtub;

b) two operating arms pivotally attached to an existed curtain crossbeam of the bathroom, said operation arms have a hinged connection with said slidable guides of the frame;

c) a tray which in extension position provide direction the gathered water to said gutter and when it is in folding position allows the user to sit down on the chair for bathing, said tray comprises: a piece of waterproof material preferably of rectangular shape having a number of strips fixed to bottom surface of said waterproof material to form a pipelines parallel each other and equally spaced; a number of ribs with bended both ends in one direction and plane, said ribs to be putted in said pipelines with bended ends up provide a folding tray with rising up sides, said folding tray by one side is fixed to said sheet member and by opposite side to the bottom ends of said operation arms to provide opening and folding the tray;

d) a curtain guard for gathering water which coming out in the process of bathing and direction it to said tray, said curtain guard comprising a curved beam fixed in horizontal plane to the existed curtain crossbeam and two curtains hanged on top by standard rings and fixed from bottom to the inside sides of said tray by fastener means.

7. The apparatus of claim 6 wherein closing and opening said folding booth are provided automatically wherein:

a) said swinging arms with slidable inside guides of the frame are accomplished as an air or hydraulic cylinders or other drive means operated by control unit;

b) said curtain guard for closing and opening said curtains comprises:

a curved beam fixed in horizontal plane to the existed curtain crossbeam, said curved beam has form of a two separate tubes secured together and each having a slit;

a driver means operated by control unit, said driver means includes a driver sheave; a motor means; a driven sheave placed in a slidable housing; a timing endless cord with two pilots on its branches, which slides in said slits and are engage with the existed curtains rings; and a spring for holding said timing cord in tension position.

8. The apparatus of claim 7 wherein there is one control unit for operation movements of the swinging arms and curtains.

* * * * *